United States Patent [19]

Hesler

[11] 4,399,663

[45] Aug. 23, 1983

[54] MECHANICAL CONTROL SYSTEM FOR PREVENTING COMPRESSOR LUBRICATION PUMP CAVITATION IN A REFRIGERATION SYSTEM

[75] Inventor: Benjamin F. Hesler, Canastota, N.Y.

[73] Assignee: Carrier Corporation, Syracuse, N.Y.

[21] Appl. No.: 325,609

[22] Filed: Nov. 27, 1981

[51] Int. Cl.[3] ..... F25B 43/02

[52] U.S. Cl. ..... 62/193; 62/217; 62/228; 62/469; 417/281

[58] Field of Search ..... 62/228 D, 228 C, 226, 62/217, 196 C, 192, 193, 203, 204, 205, 206, 231, 157, 158, 224, 225, 468, 469, 84; 417/281, 13

[56] References Cited

U.S. PATENT DOCUMENTS

| | | | |
|---|---|---|---|
| 2,715,992 | 8/1955 | Wilson | 62/196 C |
| 2,983,111 | 5/1961 | Miner et al. | 62/115 |
| 3,200,603 | 8/1965 | Wake et al. | 62/84 |
| 3,408,827 | 11/1968 | Soumerai et al. | 62/196 |
| 3,508,416 | 4/1970 | Miller | 62/84 |
| 3,873,239 | 3/1975 | Jamieson | 417/281 |
| 4,080,110 | 3/1978 | Szymaszek | 417/280 |
| 4,184,341 | 1/1980 | Friedman | 62/228 D |
| 4,208,883 | 6/1980 | Stirling | 62/192 |

*Primary Examiner*—Albert J. Makay
*Assistant Examiner*—Harry Tanner
*Attorney, Agent, or Firm*—Donald F. Daley; David L. Adour

[57] ABSTRACT

A control system for operating a vapor compression refrigeration system to prevent oil pump cavitation during startup of the refrigeration system is disclosed. The control system includes a differential pressure switch which is connected on one side to a reservoir which is in fluidic communication with the refrigeration system evaporator or compressor suction line. The pressure switch is connected on its other side directly to the evaporator or compressor suction line. In operation, the reservoir fills with vaporous refrigerant from the refrigeration system when the refrigeration system is shut down and the vaporous refrigerant flows through a restrictor valve back to the refrigeration system at startup of the refrigeration system. The size of the reservoir and restrictor valve are selected so that the differential pressure switch is activated and a control is generated when too rapid a decrease in evaporator or compressor suction line pressure is detected. The control signal is supplied to a compressor guide vane control mechanism to adjust the system pulldown rate to prevent lubrication system cavitation.

8 Claims, 2 Drawing Figures

MECHANICAL CONTROL SYSTEM FOR PREVENTING COMPRESSOR LUBRICATION PUMP CAVITATION IN A REFRIGERATION SYSTEM

BACKGROUND OF THE INVENTION

The present invention relates to vapor compression refrigeration systems, and more particularly relates to control systems for such refrigeration systems to prevent oil pump cavitation during startup of the refrigeration systems.

Vapor compression refrigeration systems of the hermetic type have an oil lubricated compressor transmission and an oil reservoir which is usually located in a housing for the transmission. An oil pump, having an inlet in the oil reservoir, pumps oil from the reservoir to the compressor transmission and bearings. During normal operation of the compressor, gaseous refrigerant in the transmission housing contacts the oil in the reservoir. To reduce compressor motor windage losses the gaseous refrigerant is maintained at relatively low pressure, during operation of the refrigeration system, by connecting the transmission housing through a pressure equalization line to the suction side of the compressor. The low pressure also reduces the amount of refrigerant absorbed into the oil during operation of the refrigeration system. However, during shutdown of a refrigeration system, the pressure in the oil reservoir rises and an increased amount of refrigerant is absorbed into the oil in the oil reservoir. The amount of refrigerant absorbed is a function of the pressure of the gaseous refrigerant above the oil in the reservoir and the temperature of the oil in the oil reservoir.

The oil in the reservoir may be heated to reduce the amount of refrigerant dissolved into the oil during shutdown. However, substantial quantities of refrigerant may dissolve into the oil during shutdown even if the oil is heated. Then, upon startup of the refrigeration system the pressure in the transmission housing is reduced and refrigerant dissolved in the oil separates from the oil creating a boiling type action. The pressure decrease is due to the connection of the suction of the compressor to the transmission housing through the pressure equalization line. The refrigerant boiling type action results in foaming of the oil and may result in the formation of vapor pockets at the inlet to the oil pump in the reservoir. This phenomenon is known as oil pump cavitation and is undesirable since it can prevent proper lubrication of the compressor transmission and bearings. Also, protective oil pressure sensing devices sense the pressure drop caused by the oil pump cavitation and may effect a shutdown of the refrigeration system.

Cycling timers which limit the rate of pulldown of refrigerant pressure in the evaporator of the refrigeration system during startup may be used to reduce oil pump cavitation. A fixed time period for controlling the position of inlet guide vanes to the compressor is set on the timer. The inlet guide vanes are controlled during the fixed time period to limit the rate of pressure drop in the evaporator and consequently reduce the boiling action of the gaseous refrigerant in the oil. Since the time period selected is fixed for all operating conditions, it is possible that oil pump cavitation may occur after the end of the fixed time period or that the rate of pulldown may be limited for a time period beyond the amount of time necessary to prevent oil pump cavitation.

Another device for reducing oil pump cavitation during startup is a differential oil pressure switch device. Usually, this type of device comprises two bellows, one of which is located in the oil circulation system, and the other of which is located at an inlet to the oil circulation system. When a pressure differential is detected indicating the occurrence of oil pump cavitation a control system responds to limit the rate of pulldown of refrigerant pressure in the evaporator of the refrigeration system. This type of differential oil pressure switch device is a relatively complex mechanical mechanism which is inherently subject to normal mechanical failure. Furthermore, this type of differential oil pressure switch device operates only after the onset of a cavitation condition and is not capable of preventing cavitation.

SUMMARY OF THE INVENTION

Therefore, an object of the present invention is to mechanically regulate the startup operation of a hermetic vapor compression refrigeration system to prevent compressor lubrication pump cavitation.

Another object of the present invention is to mechanically regulate the startup operation of a hermetic, vapor compression refrigeration system in an efficient, reliable and relatively simple manner to prevent compressor lubrication pump cavitation.

These and other objects of the present invention are attained by a control system for a vapor compression refrigeration system which comprises a reservoir for vaporous refrigerant, a differential pressure switch, a restrictor valve, and a check valve. One side of the differential pressure switch is connected to the reservoir to monitor fluid pressure in the reservoir. The other side of the differential pressure switch is connected by a conduit to the refrigeration system evaporator to monitor the gaseous refrigerant pressure in the evaporator. Alternatively, if desired, the conduit may be connected to the suction line for the compressor of the refrigeration system to monitor suction line pressure. The restrictor valve and check valve are connected in parallel to the conduit connecting the differential pressure switch to the evaporator or suction line. Gaseous refrigerant flows between the reservoir and the evaporator through the interconnecting conduit depending on the pressure difference between the vaporous refrigerant in the reservoir and the pressure of the gaseous refrigerant in the evaporator.

In operation, when the refrigeration system is shut down, the pressure of the vaporous refrigerant in the refrigeration system evaporator increases and is relatively high compared to the operating reservoir pressure. The check valve is open and allows refrigerant to flow from the evaporator to the reservoir until the pressure in the reservoir approximately equals the evaporator pressure. Then, when the refrigeration system is started, pressure drops in the evaporator thereby closing the check valve and forcing the gaseous refrigerant in the reservoir to return to the evaporator through the restrictor valve. The size of the reservoir and the size of the opening in the restrictor valve are selected to provide a controlled rate of decrease in reservoir pressure during startup. This selected rate of pressure decrease corresponds to a rate which prevents lubrication pump cavitation during startup of the refrigeration system. If the pressure drop in the evaporator is rapid enough that cavitation may occur, then the differential pressure switch senses a pressure difference causing the switch to close and supply an electrical control signal to a guide vane control mechanism which adjusts the capacity of the refrigeration system compressor to provide an evaporator pulldown rate which prevents lubrication pump cavitation.

BRIEF DESCRIPTION OF THE DRAWINGS

Further objects and advantages of the present invention will be apparent from the following detailed description in conjunction with the accompanying drawings, in which.

DESCRIPTION OF THE PREFERRED EMBODIMENT

Figure 1:
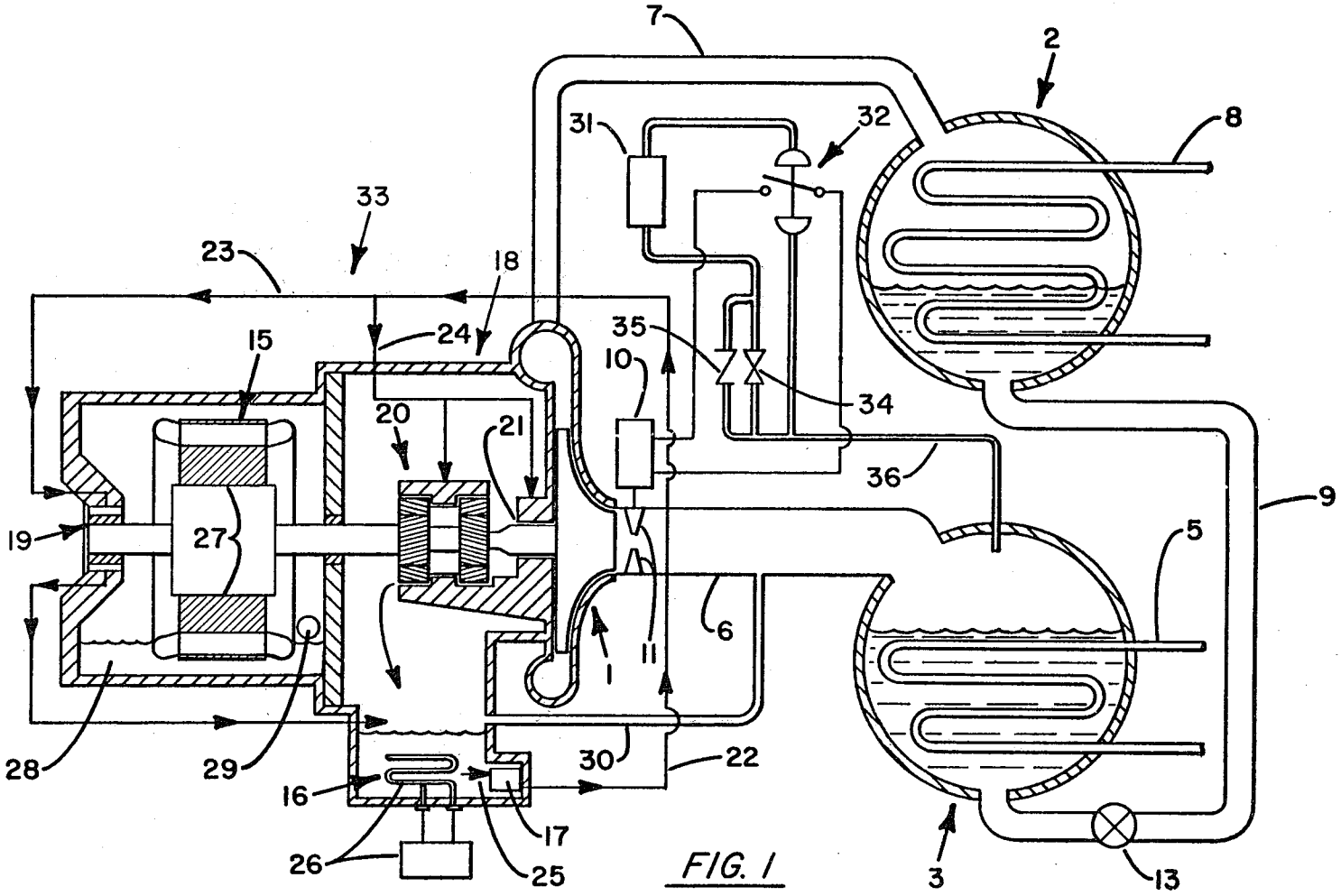
FIG. 1 is a schematic illustration of a vapor compression refrigeration system including a mechanical control system capable of operating according to the principles of the present invention.

Referring to FIG. 1, a vapor compression refrigeration system is schematically illustrated which may be operated according to the principles of the present invention to prevent refrigeration compressor lubrication pump cavitation during startup of the refrigeration system. As shown in FIG. 1, the refrigeration system comprises a compressor 1, a condenser 2, and an evaporator 3. The condenser 2 and evaporator 3 are shell and tube type heat exchangers. In the evaporator 3, heat is transferred from a heat exchange medium, such as water, flowing through heat transfer tubing 5 to refrigerant in the evaporator 3 which is vaporized. The gaseous refrigerant from the evaporator 3 flows to the compressor 1 through a line 6. The compressor 1 has inlet guide vanes 11 which control the amount of refrigerant flow to the compressor 1. The gaseous refrigerant is compressed by the compressor 1 and passes through a line 7 to the condenser 2. In the condenser 2 heat is transferred from the refrigerant to a cooling medium flowing through tubing 8 thereby transforming the refrigerant to its liquid state. The liquid refrigerant from the condenser 2 passes to the evaporator 3 through line 9 and float valve 13 to complete the closed loop heat transfer cycle.

A motor 15 drives the compressor 1 through transmission 20 in housing 18. The compressor 1, the transmission 20 and motor 15 form an oil lubricated hermetic unit 33. The lubricating oil is pumped, by the operation of a pump 17, from an oil reservoir 16 located in the transmission housing 18 to the various components of the compressor 1, the transmission 20 and motor 15 which require lubrication. The oil reservoir 16 is vented to the suction side of the compressor 1 by a pressure equalization line 30. As shown in FIG. 1, motor end bearings 19, transmission 20, and journal bearings 21 of the hermetic unit 33 are oil lubricated. The lubricating oil enters oil lubrication circuits 22, 23, and 24 via an inlet 25 in the oil reservoir 16 and the oil from each lubrication circuit 22, 23 and 24 returns to the oil reservoir 16 by gravity feed.

Refrigerant from the refrigeration system is present within the transmission housing 18 due to gaseous refrigerant entering the housing 18 via pressure equalization line 30 from the suction side of the compressor 1. Motor cooling refrigerant enters the housing 18 through an inlet port (not shown) and, after passing through motor cooling passages 27, collects in a refrigerant reservoir 28. Refrigerant leaves the reservoir 28 via outlet port 29.

The pressure of the gaseous refrigerant above the oil reservoir 16 and the temperature of the oil in the oil reservoir 16 are the major factors determining the amount of refrigerant which is absorbed by the oil. The pressure of the gaseous refrigerant in the housing 18 depends on the pressure of the gaseous refrigerant on the suction side of the compressor 1. When the refrigeration system is operating, the compressor 1 reduces the pressure in suction line 6. This reduced pressure in line 6 produces a corresponding pressure reduction in transmission housing 18 and allows refrigerant to boil out of the oil in the oil reservoir 16. However, when the refrigeration system is not operating the pressure of the gaseous refrigerant above the oil reservoir 16 approaches ambient pressure thereby increasing the amount of refrigerant which is absorbed by the oil during shutdown. An oil heater 26 is provided to heat the oil in the oil reservoir 16 to prevent undesirable amounts of refrigerant from being absorbed into the oil during shutdown. However, substantial amounts of refrigerant may be absorbed by the oil even if the oil is heated.

When the refrigeration system is started, the guide vanes 11 in the compressor suction line 6 operate in response to the cooling requirements for the system and since cooling requirements are high at startup the guide vanes open and the pressure in the suction line 6 is reduced. The pressure of the gaseous refrigerant above the oil in the oil reservoir 16 is also reduced through line 30. This produces a boiling type action of the refrigerant in the oil in the oil reservoir 16. Vigorous boiling action produces foaming and vapor pockets in the oil reservoir 16 at the inlet 25 to the oil pump 17 thereby causing oil pump cavitation. These vapor pockets may momentarily result in a substantial reduction in oil pressure in the oil lubrication circuits 22, 23 and 24 which may prevent proper lubrication of the compressor. If there are protective systems monitoring the oil pressure in the lubrication circuits 22, 23 and 24, a decrease in lubricant pressure will cause these systems to respond to shut down the refrigeration system resulting in a recycling of the system which reduces overall operating efficiency.

By operating the refrigeration system according to the principles of the present invention, oil pump cavitation and the resulting recycling of the system is prevented. Specifically, the inlet guide vanes 11, which are controlled by the inlet guide vane control mechanism 10, may be opened, during startup, at a rate which is controlled by a mechanical control system to prevent oil pump cavitation rather than to meet load requirements. In effect, the normal operation of the refrigeration system is overridden, if necessary, during startup to prevent oil pump cavitation. It should be noted that controlling the rate of pulldown during startup, according to the principles of the present invention, has other advantages besides preventing oil pump cavitation and resulting refrigeration shutdown and recycling. For example, energy savings may result because of reduced peak power demand by the system at startup and because of efficiencies obtained by reducing part-load operating time.

Figure 2:
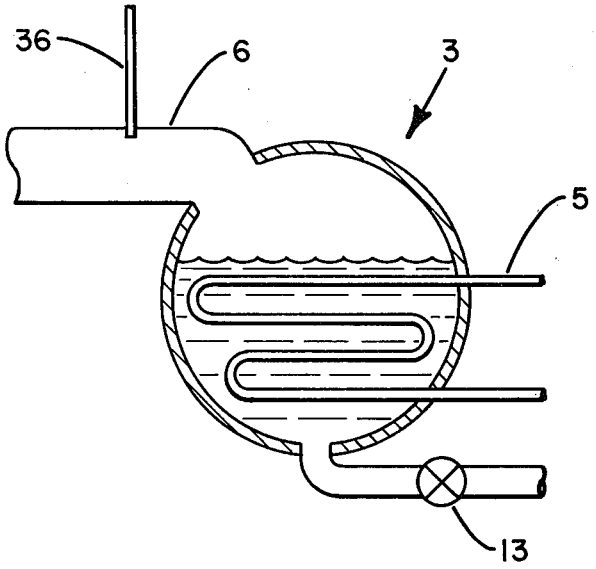
FIG. 2 is a schematic illustration of an alternative location for connection of the conduit 36 shown in FIG. 1.

As shown in FIG. 1, such a mechanical control system comprises a volume or vaporous refrigerant reservoir 31, a differential pressure switch 32, a restrictor valve 34, and a check valve 35. One side of the switch 32 is connected to the volume 31 to monitor the fluid pressure in the volume. The other side of the switch 32 is connected by conduit 36 to the evaporator 3 to monitor the gaseous refrigerant pressure in the evaporator 3. Alternatively, if desired, the conduit 36 may be connected to the suction line 6 for the compressor 1 as shown in FIG. 2. Restrictor valve 34 and check valve 35 are connected in parallel between the volume 31 and the conduit 36 to allow gaseous refrigerant to flow between the volume 31 and the evaporator 3 depending on the pressure difference between the gaseous refrigerant in the volume 31 and in the evaporator 3. The check valve 35 allows gaseous refrigerant to flow relatively freely from the evaporator 3 to the volume 31 when the pressure in the evaporator 3 exceeds the pressure in the volume 31. However, when the pressure in the evaporator 3 is less than the pressure in the volume 31 then the check valve 35 closes to prevent flow through the valve 35. The differential pressure switch 32 provides an electrical signal to the guide vane control mechanism 10 when the pressure on the volume 31 side of the switch 32 exceeds the pressure on the conduit 36 side of the switch 32 by a selected amount.

In operation, when the refrigeration system is shut down the pressure of vaporous refrigerant in the evaporator 3 increases to a relatively high level compared to the pressure of the vaporous refrigerant in the volume 31. The check valve 35 is opened due to the pressure diference and gaseous refrigerant rapidly flows from the evaporator 3 through the conduit 36 to the volume 31 until the pressure in the volume 31 approximately equals the pressure in the evaporator 3. Then, when the refrigeration system is started, the pressure in the evaporator 3 drops thereby closing the check valve 35. The gaseous refrigerant trapped in the volume 31 gradually flows through the restrictor valve 34 to the evaporator 3 until the pressure equalizes across the valve 34. Correspondingly, the pressure on the volume 31 side of the switch 32 decreases in response to the decrease in pressure in the volume 31. Also, the pressure on the conduit 36 side of the switch 32 decreases in response to the decrease in pressure in the evaporator 3. The size of the volume 31 and the size of the opening of the restrictor valve 34 are selected to provide a rate of pressure decrease in the volume 31 which corresponds to a pressure drop in the evaporator 3 and housing 18 which prevents oil pump cavitation. If the pressure in the evaporator 3 drops too rapidly, that is, if the pressure drops so rapidly that oil pump cavitation may occur, then the switch 32 senses a pressure differential which causes switch 32 to close to supply an electrical signal to the guide vane control mechanism 10. The mechanism 10 is activated by the electrical signal to adjust the flow rate of gaseous refrigerant to the compressor to reduce the rate of pressure decrease in the evaporator 3 to a level at which oil pump cavitation is no longer a problem. Preferably, the size of the volume 31 and size of the opening of the restrictor valve 34 are selected so that control action is initiated before the onset of cavitation.

It should be noted that, for certain refrigeration systems, it may be desired to connect the restrictor valve 34 and check valve 35 directly to the evaporator 3 or suction line 6 rather than to indirectly connect these valves 34 and 35 via conduit 36 to the evaporator 3 or suction line 6. This direct connection requires that two separate lines be constructed connecting the mechanical control mechanism to the evaporator 3 or suction line 6. However, direct connection may be preferred to avoid undesirable pressure variations on the evaporator 3 side of the switch 32 which are due to the flow of gaseous refrigerant from the volume 31 through the restrictor valve 34 to the conduit 36. The effects of these pressure variations may be negligible depending on the size of conduit 36, the magnitude of the flow and the operating characteristics of the particular refrigeration system. However, the direct connection of the valves 34 and 35 to the evaporator 3 or suction line 6 avoids the effects of such pressure variations.

Finally, while the present invention has been described in conjunction with a particular embodiment it is to be understood that various modifications and other embodiments of the present invention may be made without departing from the scope of the invention as described herein and as claimed in the appended claims.

What is claimed is:

1. A control system for preventing oil pump cavitation by controlling flow of vaporous refrigerant to a compressor in a hermetically sealed refrigeration system of the type wherein a lubricating oil reservoir is located in a housing filled with vaporous refrigerant at a pressure proportional to the refrigerant pressure in the refrigeration system evaporator comprising:

a reservoir for vaporous refrigerant;

means for connecting the reservoir to the refrigeration system evaporator;

means for permitting refrigerant flow from the evaporator to the reservoir when the pressure in the evaporator exceeds the pressure in the reservoir;

means for controlling the rate of flow of refrigerant from the reservoir to the evaporator when the pressure in the reservoir exceeds the pressure in the evaporator;

differential pressure sensing means responsive to the difference in pressure between the evaporator and the reservoir; and means for controlling the flow of vaporous refrigerant to the compressor from the evaporator in response to the differential pressure sensing means when the differential pressure sensing means senses a predetermined higher pressure in the reservoir than the evaporator.

2. A control system as recited in claim 1 wherein the means for controlling the rate of flow of refrigerant from the reservoir to the evaporator comprises a restrictor valve located in a conduit connecting the evaporator to the reservoir and wherein the means for permitting refrigerant flow from the evaporator to the reservoir comprises a check valve connected in parallel to the restrictor valve.

3. A control system as recited in claim 1 wherein the differential pressure sensing means comprises a differential pressure switch.

4. A control system as recited in claim 1 wherein the means to control the flow of vaporous refrigerant to the compressor from the evaporator comprises compressor inlet guide vanes operated by an inlet guide vane actuator.

5. A control system for preventing oil pump cavitation by controlling flow of vaporous refrigerant to a compressor in a hermetically sealed refrigeration system of the type wherein a lubricating oil reservoir is located in a housing filled with vaporous refrigerant at a pressure proportional to refrigerant pressure on the suction side of the compressor, said control system comprising:

a reservoir for vaporous refrigerant;

means for connecting the reservoir to the suction side of the compressor;

means for permitting refrigerant flow from the suction side of the compressor to the reservoir when the pressure on the suction side of the compressor exceeds the pressure in the reservoir;

means for controlling the rate of flow of refrigerant from the reservoir to the suction side of the compressor when the pressure in the reservoir exceeds the pressure on the suction side of the compressor;

differential pressure sensing means responsive to the difference in pressure between the pressure on the suction side of the compressor and the pressure in the reservoir; and means for controlling the flow of vaporous refrigerant to the compressor in response to the differential pressure sensing means when the differential pressure sensing means senses a predetermined higher pressure in the reservoir than the pressure on the suction side of the compressor.

6. A control system as recited in claim 5 wherein the means for controlling the rate of flow of refrigerant from the reservoir to the suction side of the compressor comprises a restrictor valve located in a conduit connecting the suction side of the compressor to the reservoir and wherein the means for permitting refrigerant flow from the suction side of the compressor to the reservoir comprises a check valve connected in parallel to the restrictor valve.

7. A control system as recited in claim 5 wherein the differential pressure sensing means comprises a differential pressure switch.

8. A control system as recited in claim 5 wherein the means to control the flow of vaporous refrigerant to the compressor comprises compressor inlet guide vanes operated by an inlet guide vane actuator.

* * * * *